US005115169A

United States Patent [19]

Aoki

[11] Patent Number: 5,115,169

[45] Date of Patent: May 19, 1992

[54] FLASH LIGHT CONTROL CIRCUIT

[75] Inventor: Tetsushi Aoki, Hachioji, Japan

[73] Assignee: Konica Corporation, Tokyo, Japan

[21] Appl. No.: 601,999

[22] Filed: Oct. 23, 1990

[30] Foreign Application Priority Data

Oct. 31, 1989 [JP] Japan ..... 1-2845504

[51] Int. Cl.[5] ..... H05B 41/32

[52] U.S. Cl. ..... 315/241 R; 315/241 P; 354/145.1

[58] Field of Search ..... 315/241 R, 241 P, 241 S, 315/200 A, 208, 307; 354/145.1, 415

[56] References Cited

U.S. PATENT DOCUMENTS 4,302,707 11/1981 Hattori ..... 315/241 P 4,652,108 3/1987 Iida et al. ..... 315/241 P X

*Primary Examiner*—Eugene R. LaRoche

*Assistant Examiner*—Ali Neyzari

*Attorney, Agent, or Firm*—Jordan B. Bierman

[57] ABSTRACT

An object of the invention is to provide a flash light control circuit by which a flash bulb is controlled to maintain a constant quantity of emitted light at each flash, in order to counter an insufficient exposure of a photographic object, caused by a gradual decrease of emitted light with the progress of exposures, for example, in photography with a camera on a multi exposure basis.

The object is achieved by a flash light control circuit comprising a trigger circuit that impresses a trigger voltage onto a trigger terminal of the flash bulb and comprising a non-self hold type switching element connected to the trigger circuit, which is turned on for discharging energy stored in a main capacitor into the flash bulb for its consequent flashing, wherein there is provided a pulse generating circuit that impresses, onto a gate terminal of the switching element, continual pulse signals whose duty ratios increase gradually.

4 Claims, 3 Drawing Sheets

FIG. 4
(PRIOR ART)
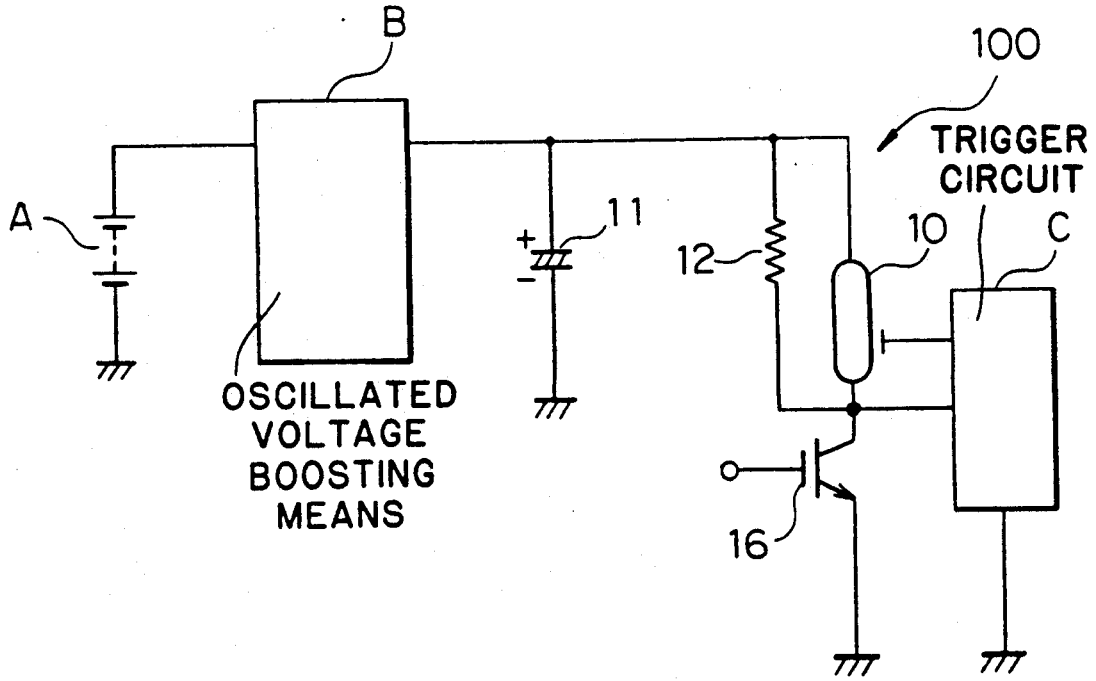
FIG. 5(a)
(PRIOR ART)
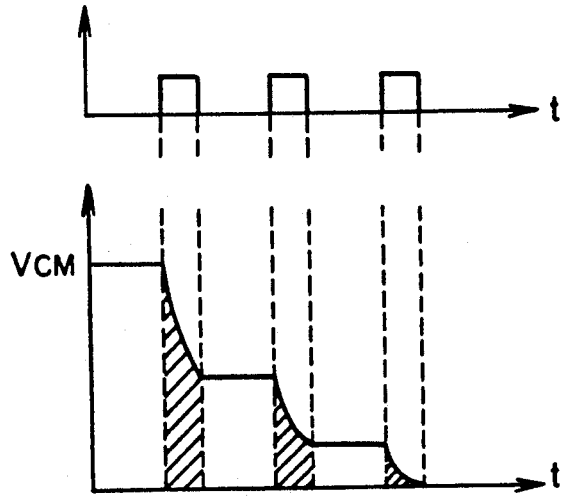
FIG. 5(b)
(PRIOR ART)

FLASH LIGHT CONTROL CIRCUIT

BACKGROUND OF THE INVENTION

The present invention relates to a flash light control circuit that controls a quantity of light emitted from a flash bulb so that an optimum exposure may be obtained from a photographic object and others in the course of photographing by means of a camera.

FIG. 4 represents a block diagram showing a flash light control circuit that controls a quantity of emitted light by regulating the discharging time of a flash bulb using an ordinary non-self-hold type semiconductor switching element.

Flash light control circuit 100 is composed of power source circuit A, oscillated voltage boosting means B that oscillates and boosts voltage generated from power source circuit A and thereby charges main capacitor 11, flash bulb 10 that flashes when electric charges charged in aforesaid main capacitor 11 are discharged, main capacitor 11 that holds energy for aforesaid discharge, resistor element 12, trigger circuit C that impresses trigger voltage on aforesaid flash bulb 10 and non-self-hold type semiconductor switching element such as IGBT (hereinafter referred to as switching element) 16 that starts aforesaid trigger circuit C and controls light emission of flash bulb 10. When one terminal of flash bulb 10 and one terminal of a coil positioned at the primary side of a trigger transformer in trigger circuit C are connected electrically to a collector terminal of aforesaid switching element 16 and thus the switching element 16 is turned on and turned off, a period of time for discharging energy stored in aforesaid main capacitor 11 into flash bulb 10 is regulated and thereby a quantity of emitted light is controlled and also the control is made so that terminal voltage V CM on main capacitor 11 may cause the flash bulb to flash a number of times.

FIG. 5 represents a graph showing actions of the flash light control circuit made in the occasion that flash bulb 10 flashes a number of times.

In the figure, pulse signals to be impressed on a gate terminal of switching element 16 are shown in (a) and variations of terminal voltage V CM on main capacitor 11 are shown in (b). Each hatched area in (b) corresponds approximately to the quantity of emitted light.

In aforesaid flash light control circuit 100, however, when one terminal of flash bulb 10 and an input terminal of the trigger circuit are electrically connected to a collector terminal of switching element 16, and flash bulb 10 is caused to flash partially or on a split flashing basis for a certain frequency by turning on and turning off switching element 16 for the frequency identical to aforesaid frequency, electric charges charged in main capacitor 11 are discharged each time the flash bulb flashes partially as shown in FIG. 5, resulting in the drop of terminal voltage V CM on main capacitor 11 which voltage drop causes the sharp reduction of the quantity of light emitted from flash bulb 10. Therefore, when photographing with a camera on a multi exposure basis, for example, an exposure level or the exposure amount caused by a photographic object to be photographed decreases gradually with the progress of exposures, which has been a problem.

SUMMARY OF THE INVENTION

An object of the invention is to provide a flash light control circuit capable of causing a flash bulb to continue intermittently flashing keeping a constant quantity of emitted light for the purpose of coping with photographing on a multi exposure basis.

Above-mentioned object of the invention is achieved by a flash light control circuit comprising trigger circuit that impresses trigger voltage on one terminal of a flash bulb and on a trigger terminal and comprising a non-self-hold type switching element connected electrically to the trigger circuit and is turned on for discharging light emission energy stored in a main capacitor into aforesaid flash bulb for its consequent flashing, wherein there is provided a pulse generating circuit that impresses on a gate terminal of aforesaid semiconductor switching element the continual pulse signals in which the duty ratio of each pulse signal grows greater gradually.

BRIEF DESCRIPTION OF THE DRAWINGS

FIG. 4 is a block diagram showing a general flash light control circuit and FIGS. 5(*a*) and 5(*b*) represent a graph showing actions made by the flash light control circuit when flash bulb 10 flashes a number of times.

DESCRIPTION OF THE PREFERRED EMBODIMENT

Figure 1:
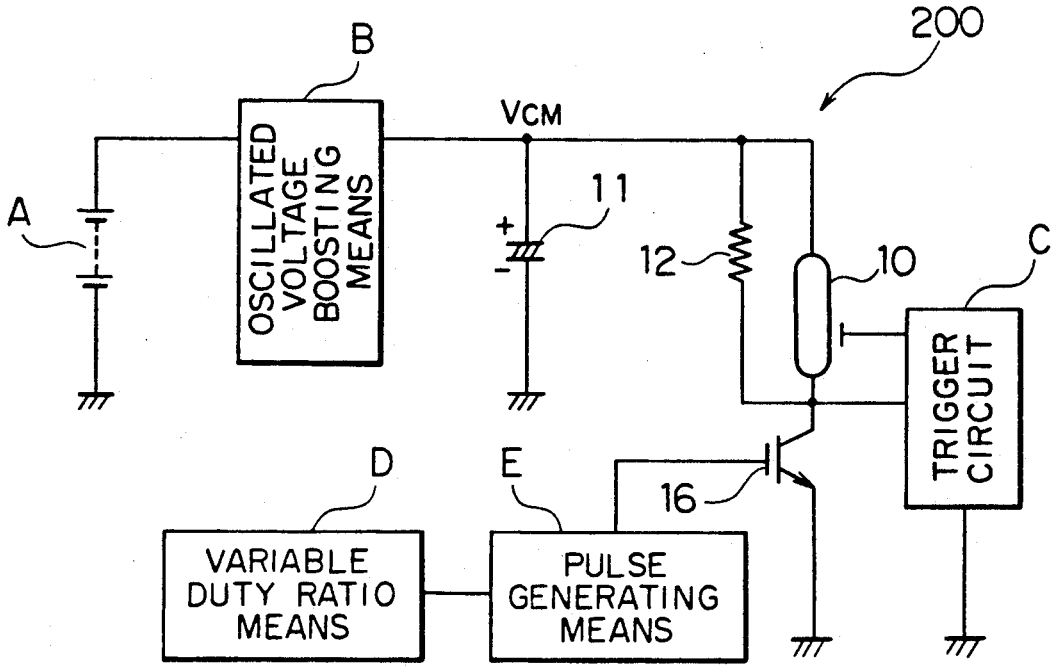
FIG. 1 is a block diagram showing a schematic of a flash light control circuit of the invention.

FIG. 1 is a block diagram showing a schematic structure of a flash light control circuit of the invention.

Flash light control circuit 200 of the invention controls flash bulb 10 so that it may be caused, by terminal voltage V CM generated in main capacitor 11 by a single charging operation, to flash a number of times with almost equal quantity of emitted light.

Flash light control circuit 200 is composed, for example, of power source circuit A such as a battery, oscillated voltage boosting means B that oscillates and boosts boltage generated from the power source circuit A and charges it in main capacitor 11, flash bulb 10 that flashes when electric charges charged in the main capacitor 11 are discharged, main capacitor 11 wherein energy to be used for aforesaid discharging is stored, resistor element 12, trigger circuit C that impresses trigger voltage on aforesaid flash bulb 10, and non-self-hold type semiconductor switching element 16 that starts aforesaid trigger circuit C and thus causes flash bulb 10 to start flashing and then suspend flashing, which is identical to the prior art, and it is further composed of variable duty ratio means D that changes the duty ratio to be great or small and of pulse generating means E the pulse signals from which are impressed on a gate terminal of aforesaid switching element 16.

Operations for flashing through the flash light control circuit of the invention will be explained as follows.

Figure 2:
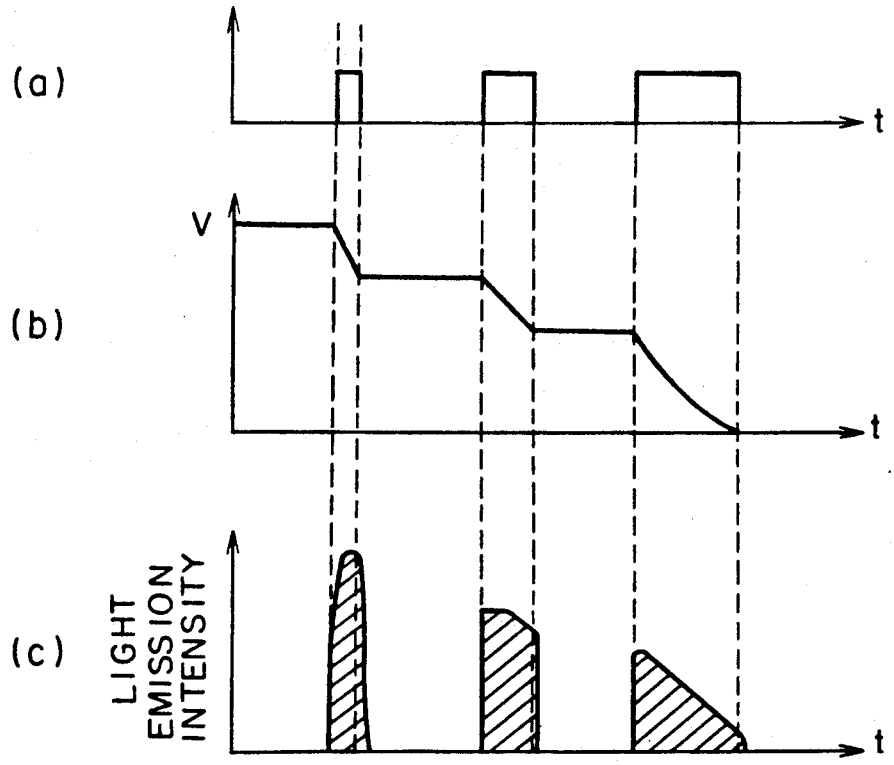
FIG. 2 is a graph showing flashing actions of a flash bulb in the flash light control circuit of the invention.

FIG. 2 is a graph showing the operations for flashing of a flash bulb through the flash light control circuit of the invention.

In the figure, pulse signals to be impressed on a gate terminal of switching element 16 are indicated in (a), variations of terminal voltage V CM of main capacitor 11 are indicatited in (b), and the quantity of light emitted from flash bulb 10 are indicated in (c). In this case, switching element 16 will be explained as a high-active one wherein the switching element is turned on when the level of voltage on a gate terminal is high.

Pulse signals to be impressed on a gate terminal of switching element 16 are controlled so that they rise gradually to a high level state, namely, the period of time for switching element 16 to be in the state of ON is controlled to become longer. Terminal voltage of V CM on main capacitor 11 is lowered during the period when switching element 16 is in the state of ON (See (b).). When switching element 16 is in the state of ON, current from main capacitor 11 keeps causing discharge in flash bulb 10, and the quantity of emitted light in this case is shown in (c) wherein the hatched areas are mostly the same each other.

As stated above, the flash light control circuit of the invention controls a period of time during which flash bulb 10 is caused to flash by the discharge in main capacitor 11 so that the period of time becomes longer gradually, thus, split flashing with an equal quantity of emitted light can be repeated.

Incidentally, when switching element 16 is of a low-active type, namely, when it is one which is in the state of ON when pulse signals to be impressed on a gate terminal are on the low level, pulse signals to be impressed on switching element 16 are to be controlled so that the period of time for them to be in the low state becomes longer gradually, thus split flashing with an equal quantity of emitted light can be repeated in the same way as in the foregoing.

Next, the invention will be explained as follows based on examples, referring to the drawings attached.

Figure 3:
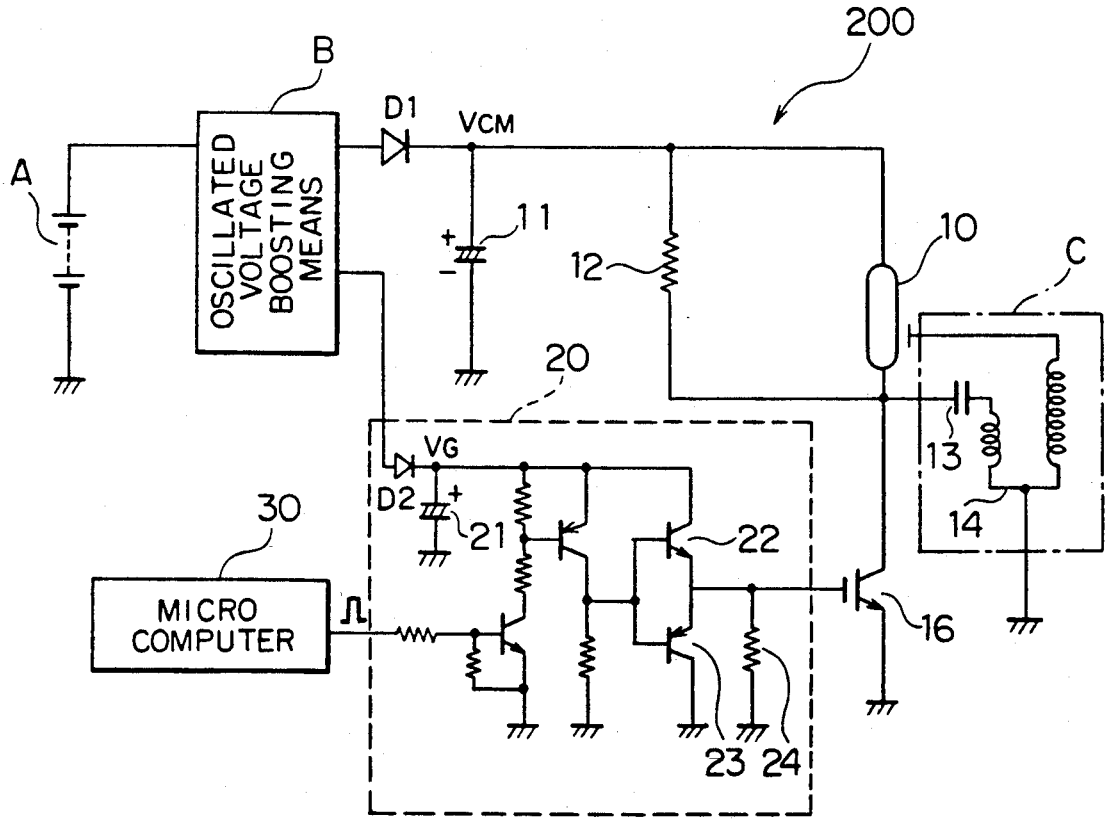
FIG. 3 is a block diagram showing a flash light control circuit in the present example.

FIG. 3 is a block diagram showing a flash light control circuit in the example.

Flash light control circuit 200 in the present example is composed, for example, of oscillated voltage boosting circuit B, a xenon tube as flash bulb 10, main capacitor 11, resistor element 12. trigger circuit C, IGBT made by Mitsubishi Electric Co. (hereinafter referred to as IGBT) as a non-self-hold type semiconductor switching element that starts aforesaid trigger circuit C and thereby initiates and then suspends flashing of xenon bulb 10, driving circuit 20 that drives the IGBT 16, and microcomputer 30 that generates signals for driving the driving circuit 20. Incidentally, explanation of items which have been explained in flash light control circuit 200 shown in FIG. 1 will be omitted.

Trigger circuit C is composed of trigger capacitor 13 and trigger transformer 14, and when trigger capacitor 13 is discharged, high voltage such as, for example, of 2 kV is excited on the secondary coil of trigger transformer 14 and gas is excited in xenon bulb 10. Microcomputer 30 generates signals for changing the duty ratio. Based upon signals from microcomputer 30, driving circuit 20 impresses pulse signals on a gate terminal of IGBT 16.

Explanation of how primary components of flash light control circuit 200 such as xenon bulb 10, main capacitor 11, trigger circuit C, resistor element 12 and IGBT 16 are connected will be made as follows.

Main capacitor 11, xenon bulb 10 and IGBT 16 form a closed loop. Resistor element 12 is connected in parallel with xenon bulb 10. In trigger circuit C, one terminal of trigger capacitor 13 is connected, in series, to trigger transformer 14, and the other terminal of trigger capacitor 13 is connected to the point where xenon bulb 10 and a collector terminal of IGBT 16 are connected, and a tip of a secondary coil of trigger transformer 14 is connected to a trigger terminal of xenon bulb 10. Under such connection, when IGBT 16 is turned on, trigger circuit C is started, and when IGBT 16 is turned off, the flow of current in xenon bulb 10 is stopped and thereby discharge is suspended.

Operations for controlling the quantity of light emitted from a flash bulb in flash light control circuit 200 of the present example will be explained as follows.

First, oscillated voltage boosting means B oscillates and boosts voltage generated from power source circuit A and charges trigger capacitor 13 up to V CM through main capacitor 11 and resistor element 12, and charges capacitor 21 up to voltage VG which is supplied on a gate of IGBT 16 to cause IGBT 16 to be in the state of ON.

Next, pulse signals from the driving circuit are impressed on a gate terminal of IGBT 16 based on signals from microcomputer 30, which causes IGBT 16 to be in the state of ON. Thereby, trigger capacitor 13 starts its discharging to cause a primary current to be excited in a primary coil of trigger transformer 14, which causes high voltage to be excited in a secondary coil. When the high voltage is impressed on a trigger terminal of xenon bulb 10, xenon gas in xenon bulb 10 is excited to cause the inside of xenon bulb 10 to be on the low resistance level, thus, charges stored in main capacitor 11 are discharged and flow in xenon bulb 10, resulting in emission of light in xenon bulb 10. Then, when a gate of IGBT 16 is caused to be on a low level by pulse signals from driving circuit 20, IGBT 16 is made to be in the state of OFF, thus emission of light in xenon bulb 10 is suspended. Thus, when each period of time for IGBT 16 to be in the state of ON is caused to become longer gradually by impressing on a gate terminal of IGBT 16 the continual pulse signals from driving circuit 20 whose duty ratios become greater gradually, a period of time for emission of light in xenon bulb 10 is made longer gradually. Therefore, there is provided an advantage that the quantity of emitted light of each flashing among continual ones can be mostly the same.

As stated above, the invention provides a flash light control circuit comprising a non-self-hold type switching element connected to a trigger circuit that impresses trigger voltage on a terminal at one terminal of a flash bulb and on a trigger terminal thereof, said non-self-hold type switching element being turned on to cause light emission energy stored in a main capacitor to be discharged in aforesaid flash bulb, wherein there is provided a pulse generating circuit that impresses on a gate terminal of aforesaid semiconductor switching element the continual pulse signals whose duty ratios become greater gradually, thereby a period of time for the switching element to be in the state of ON becomes longer gradually resulting in continual emission of light each having the similar quantity of emitted light, thus it is possible to keep a period of time wherein flashing with similar quantity of emitted light can be repeated, and it is possible, for example, to cause a flash bulb to continue flashing while keeping the quantity of emitted light almost constant to fit photographing on a multi exposure basis.

What is claimed is:

1. A flash bulb control circuit for controlling the quantity of light emitted from said flashbulb, said circuit comprising (a) a switching element electrically connected to one terminal of said flashbulb and to a trigger circuit, by which a trigger voltage is impressed on a trigger terminal of said flashbulb thereby causing an ON state in said switching element wherein energy stored in a main capacitor is discharged into said flashbulb to cause said bulb to flash:

(b) a signal emitter adapted to output a signal to extend the duration of said ON state based on discharging characteristics of said flashbulb;

(c) a receiving circuit for controlling the duration of said ON state based upon said signal from said signal emitter;

whereby quantities of light emitted by said flashbulb are substantially equal in successive flashings of said flashbulb.

2. The control circuit of claim 1 wherein said receiving means comprises a pulse generating circuit for applying pulse signals to a gate terminal of said switching element whereby duty ratios of successive signals increase gradually.

3. The control circuit of claim 1 wherein duty ratios of successive signals are gradually increased by a variable duty device.

4. The control circuit of claim 1 wherein said switching element is a non self-hold semiconductor switching element.

* * * * *